US005978616A

United States Patent [19]

Shin

[11] Patent Number: 5,978,616

[45] Date of Patent: Nov. 2, 1999

[54] CONTACT CHARGER OF AN ELECTROPHOTOGRAPHIC IMAGE FORMING APPARATUS

[75] Inventor: Kyu-Cheol Shin, Kwachon, Rep. of Korea

[73] Assignee: SamSung Electronics Co., Ltd., Kyungki-do, Rep. of Korea

[21] Appl. No.: 09/134,917

[22] Filed: Aug. 17, 1998

[30] Foreign Application Priority Data

Aug. 16, 1997 [KR] Rep. of Korea ..... 97-39106

[51] Int. Cl.[6] ..... G03G 15/02; G03G 21/00

[52] U.S. Cl. ..... 399/50; 399/100

[58] Field of Search ..... 399/50, 48, 100, 399/174, 176, 168, 34, 71; 430/902; 361/221, 225

[56] References Cited

U.S. PATENT DOCUMENTS

| | | | |
|---|---|---|---|
| 4,796,064 | 1/1989 | Torrey | 399/50 |
| 4,939,542 | 7/1990 | Kurando et al. | 399/50 |
| 5,173,734 | 12/1992 | Shimizu et al. | 399/50 |
| 5,412,455 | 5/1995 | Ono et al. | 399/176 |
| 5,499,080 | 3/1996 | Furuya et al. | 399/50 |
| 5,523,831 | 6/1996 | Rushing | 399/50 X |
| 5,557,373 | 9/1996 | Miyashita et al. | 399/9 |
| 5,572,293 | 11/1996 | Kikuchi et al. | 361/225 X |
| 5,619,308 | 4/1997 | Kinoshita et al. | 399/48 |
| 5,659,839 | 8/1997 | Mizude et al. | 399/50 |
| 5,666,608 | 9/1997 | Christensen | 399/176 |
| 5,671,468 | 9/1997 | Yamamoto et al. | 399/169 |
| 5,697,013 | 12/1997 | Sasaki | 399/55 |
| 5,715,499 | 2/1998 | Yamazaki et al. | 399/50 |
| 5,749,022 | 5/1998 | Kikui et al. | 399/50 |
| 5,768,653 | 6/1998 | Faré | 399/50 |
| 5,805,954 | 9/1998 | Takahashi | 399/50 X |

*Primary Examiner*—Sandra Brase
*Assistant Examiner*—Sophia S. Chen
*Attorney, Agent, or Firm*—Robert E. Bushnell, Esp.

[57] ABSTRACT

A charger for charging the surface of a photoconductive drum by a contact charging method in an electrophotographic image forming apparatus includes: a charge roller for charging an unexposed surface of the photoconductive drum to a prescribed potential by contact with the surface of the photoconductive drum; a power supply connected to the charge roller, for supplying a variable DC charge voltage to the charge roller; a potential sensor installed around the photoconductive drum, for detecting a charge potential value of the unexposed surface of the photoconductive drum; and a controller for comparing the charge potential value detected by the potential sensor with a specified value, and changing the charge voltage generated by the power supply upon detecting any difference therebetween, so as to maintain the charge potential of the photoconductive drum at a constant value.

8 Claims, 6 Drawing Sheets

FIG. 1 *(Related Art)*

FIG. 2 *(Related Art)*

FIG. 3 *(Related Art)*

CONTACT CHARGER OF AN ELECTROPHOTOGRAPHIC IMAGE FORMING APPARATUS

CLAIM OF PRIORITY

This application makes reference to, incorporates the same herein, and claims all benefits accruing under 35 U.S.C. §119 from an application for CONTACT CHARGING DEVICE IN ELECTROPHOTOGRAPHIC IMAGE FORMING APPARATUS earlier filed in the Korean Industrial Property Office on the Aug. 16, 1997 and there duly assigned Ser. No. 39106/1997.

BACKGROUND OF THE INVENTION

1. Field of the Invention

The present invention relates to an electrophotographic image forming apparatus, and more particularly, to a charger for charging the surface of a photoconductive drum by a contact charging method.

2. Description of the Related Art

An electrophotographic developing method is widely used in an image forming apparatus such as a copier, a laser beam printer, an LPH (LED print head) printer, and a plain paper facsimile machine. The electrophotographic developing method has the successive processes of: charging→exposing→developing→transfer→fixing.

In an electrophotographic image forming apparatus with a contact charger, a developing device includes a developing roller, a supply roller, a developing agent regulating blade and an agitator. A photoconductive drum, a charger roller, the developing roller, the supply roller, and a transfer roller rotate by means of a driving mechanism including an engine driving motor. A sheet is fed from a sheet cassette and conveyed along a sheet convey path and finally ejected to the exterior of the image forming apparatus.

Typically, the photoconductive drum is charged to a negative charge voltage by the charge roller and forms uniform charge on its surface. As the photoconductive drum rotates, its surfaces subject to an exposing process to form an electrostatic latent image. A non-image area of the surface of the photoconductive drum which has not been exposed to light maintains its original potential, while the potential of the exposed image area is decreased. The photoconductive drum forming the electrostatic latent image on its surface reaches a developing area as it rotates and the electrostatic latent image is developed into a visual image by a developing agent on the developing roller.

The developing roller has a negative developing potential and a negative bias voltage is supplied to the supply roller and the developing agent is charged to a negative potential by the difference in potential between the bias voltage of the developing roller and the bias voltage of the supply roller so as to adhere to the developing roller. The developing agent adhering to the developing roller is moved to an exposing area on the photoconductive drum due to the difference between the exposing potential of the photoconductive drum and the developing potential of the developing roller so that the developing agent adheres to the exposed area on the photoconductive drum.

The characteristic of the charge potential of the photoconductive drum charged by the charge roller varies according to the charge voltage of the charge roller and the environmental conditions. When the charge voltage applied to the charge roller is a DC voltage, the charge potential of the photoconductive drum is decreased as temperature and humidity are increased and is increased as temperature and humidity are decreased.

The developing agent on the developing roller is moved to the surface of the photoconductive drum by the difference in potential between the photoconductive drum and the developing roller. The amount of developing agent moved is proportional to the difference between the developing voltage and the charge potential of the photoconductive drum. Under the same charge voltage of the charge roller, the actual charge potential of the photoconductive drum differs according to environmental conditions. Therefore, the amount of developing agent on the photoconductive drum differs and thus image density varies, resulting in a degradation in image quality.

In order to prevent this problem, a charge voltage to which an AC component is superimposed has been applied to the charge roller so as to result in a charge potential with a relatively stable characteristic.

The characteristic of the charge potential of the photoconductive drum may differ when the charge roller is polluted by the developing agent or paper dust and if the charge roller is polluted, the charge potential of the photoconductive drum is lowered resulting in a unstable characteristic of charge potential with respect to the charge voltage of only a DC component. If the charge voltage includes AC component, the characteristic of the charge potential of the photoconductive drum becomes relatively stable. However, since voltage applied to the photoconductive drum and the charge roller varies according to an AC characteristic of the charge voltage, the electrostatic force therebetween differs. Then, the charge roller having an elastic characteristic due to the fact that it is normally formed on a rubber material, repeats contraction and expansion according to a period of an AC voltage frequency, thereby generating minute vibrations. The vibrations cause noise and a degradation in image quality. To prevent the vibration noise and to improve image quality, there is additionally needed vibration preventing device.

The following patents each discloses features in common with the present invention: U.S. Pat. No. 4,796,064 to Torrey, entitled Cycle-Up Control Scheme, U.S. Pat. No. 4,939,542 to Kurando et al., entitled Image Forming Apparatus With Potential Control, U.S. Pat. No. 5,412,455 to Ono et al., entitled Charging Device, Image Forming Apparatus And Detachably Mountable Process Cartridge Having A Constant Voltage Power Source Feature, U.S. Pat. No. 5,499,080 to Furuya et al. entitled Image Forming Apparatus Having A Voltage Controlled Contact Charger, U.S. Pat. No. 5,557,373 to Miyashita et al., entitled Cleaning System For Charging Drum Of An Image Forming Apparatus, U.S. Pat. No. 5,619,308 to Kinoshita et al., entitled Electrophotographic Image Forming Apparatus Adjusting Image Forming Means Based On Surface Voltage Of Photoconductor, U.S. Pat. No. 5,666,608 to Christensen, entitled Charging Member And Image Forming Member Space Apparatus, U.S. Pat. No. 5,659,839 to Mizude et al., entitled Voltage Control Apparatus For Controlling A Charger In An Image Forming Apparatus, U.S. Pat. No. 5,671,468 to Yamamoto et al., entitled Charging Member And Image Forming Apparatus Having Contact Charging Member, U.S. Pat. No. 5,697,013 to Sasaki, entitled Image Forming Apparatus For Forming Images In Accordance With An Electrophotographic Process, U.S. Pat. No. 5,715,499 to Yamazaki et al., entitled Contact Charger Having An Oscillating Voltage For Charging A Photosensitive Member, U.S. Pat. No. 5,749,022 to Kikui et al., entitled Charging Apparatus And Method For Use In Image Forming Device, and U.S. Pat. No. 5,768,653 to Faré, entitled Electrophotographic Printing Device With A Charging Roller.

Torrey '064 discloses a control device including a charging member, a sensor to measure the surface potential on an image bearing member—logic circuitry—means to determine relationship between charging current of the charging member and the measured surface potential of the image bearing member. Kuroando '542 discloses image forming apparatus with a potential sensor for measuring a potential at the surface of a photoreceptor drum—controlling an output from the charger. Ono '455 discloses a charging member—an image forming apparatus—a charging member for supplying the oscillating voltage to the charging member—a constant voltage element. Furuya '080 discloses an image forming apparatus having a voltage controlled contact charger. Miyashita '373 discloses an image forming apparatus including a charging member—a cleaning member—a controller is implemented by a microcomputer and controls various operations of the image forming apparatus. Kinoshita '308 discloses an electrophotographic image forming apparatus—a photoconductive drum—a voltage sensor for detecting a surface voltage—adjusted by an adjustment controller based on a surface voltage. Christensen '608 discloses an electrophotographic printing system—a spacer apparatus provides separation between a photoconductor drum and a charge roller. Mizude '839 discloses a voltage control apparatus for controlling a charger in an image forming apparatus—a controller corrects an output voltage value of the voltage value of the voltage generator to a voltage value necessary for the drum surface to be charged. Yamamoto '468 discloses a charging member and an image forming apparatus having a contact charging member. Sasaki '013 discloses image forming apparatus for forming images in accordance with an electrophotographic process. Yamazaki '499 discloses a contact charger having an oscillating voltage for charging a photosensitive member. Kikui '022 discloses a charging apparatus and a method for use in an image forming device—a controller controls an amount of the applied voltage. Fare '653 discloses an electrophotographic printing device with a charging roller for a photoconductive drum—a residual charged transferred by the charging roller to the drum can be controlled.

As noted above, earlier chargers lead to poor uniformity of image density according to a change in environmental conditions or the pollution of the charge roller. When the charge voltage including an AC component is applied to the charge roller, a vibration preventing device is required.

SUMMARY OF THE INVENTION

An object of the present invention is to provide a charger which can maintain uniform image density without using a vibration preventing device.

To achieve the object of the present invention, there is provided a charger for charging the surface of a photoconductive drum by a contact charging method in an electrophotographic image forming apparatus, including: a charge roller for charging the unexposed surface of the photoconductive drum to a prescribed potential by contact with the surface of the photoconductive drum; a power supply connected to the charge roller, for supplying a variable direct current (DC) charge voltage to the charge roller; a potential sensor installed around the photoconductive drum, for detecting a charge potential value of the unexposed surface of the photoconductive drum; and a controller for comparing the charge potential value detected by the potential sensor with a specified value, and for changing the charge voltage generated by the power supply upon detecting any difference therebetween, so as to maintain the charge potential of the photoconductive drum at a constant value.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
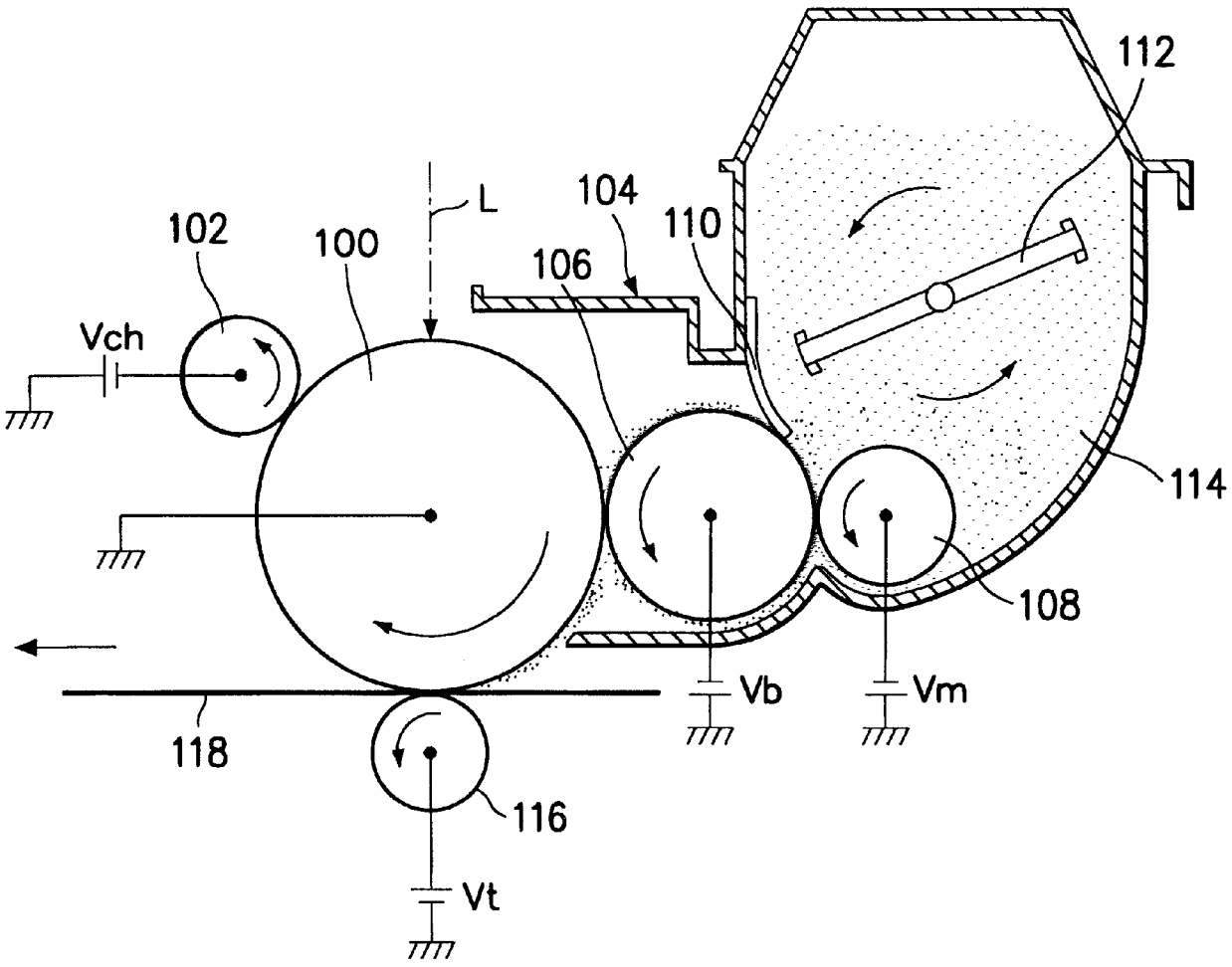
FIG. 1 illustrates an engine of an electrophotographic image forming apparatus including an earlier contact charger.

In the following description, numerous specific details are set forth to provide a more thorough understanding of the present invention. It will be apparent, however, to one skilled in the art that the present invention may be practiced without these specific details. In other instances, well known functions or constructions have not been described so as not to obscure the subject matter of the present invention. It should be noted that like reference numerals and symbols designate like or corresponding parts throughout several views.

FIG. 1 illustrates an engine of an electrophotographic image forming apparatus with a contact charger. There is also shown a bias voltage supplying state. A developing device 104 includes a developing roller 106, a supply roller 108, a developing agent regulating blade 110, and an agitator 112. A photoconductive drum 100, a charge roller 102, the developing roller 106, the supply roller 108, and a transfer roller 116 rotate in the direction of respective arrows as shown in FIG. 1, by driving a mechanism including an engine driving motor (not shown). A sheet is fed from a sheet cassette (not shown), conveyed along a sheet convey path 118, and finally ejected to the exterior of the image forming apparatus.

An electrophotographic process will now be described with reference to FIG. 1. In a charge process, the photoconductive drum 100 is charged to a negative charge voltage Vch, −1400V for example, by the charge roller 102 and forms uniform charges with a negative potential of about −800V on its surface. As the photoconductive drum 100 rotates, its surface is subject to an exposing process. The surface of the photoconductive drum 100 is exposed by light L of an exposing device (not shown), thereby forming an electrostatic latent image. A non-image area of the surface of the photoconductive drum 100 which is not exposed to the light maintains its original potential, while the potential of the exposed image area is decreased to a negative voltage equal to several tens of volts. As the exposing unit, there is a laser scanner unit used in a laser beam printer or a document scanner used in a copier. The photoconductive drum 100 forming the electrostatic latent image on its surface reaches a developing area as it rotates. The developing area is a contact part between the photoconductive drum 100 and the developing roller 106.

The photoconductive drum 100 reaching the developing area is subject to a developing process. The electrostatic latent image formed on the photoconductive drum 100 is developed into a visual image by a developing agent on the developing roller 106. In this case, a developing agent 114 within the developing device 104 is supplied to the developing roller 106 by the supply roller 106. The agitator 112 within the developing device 104 agitates the developing agent 114 by its rotation to mix a used developing agent with a new developing agent.

The developing roller 106 has a negative developing potential, −300V for example, due to a negative developing voltage Vb. A negative bias voltage Vm, −500V for instance, is applied to the supply roller 108. Then the developing agent is charged to a negative potential by the difference in potential between the bias voltage of the developing roller 106 and the bias voltage of the supply roller 108, and it adheres to the developing roller 106 by image force. The uniform quantity of the developing agent adheres to the developing roller 106 by the regulating blade 110. The developing agent adhering to the developing roller 106 is moved to an exposing area on the photoconductive drum 100 by electrostatic force due to the difference between the exposing potential of the photoconductive drum 100 and the developing potential of the developing roller 106. Thus, the developing agent adheres to the exposed area on the photoconductive drum 100.

A sheet fed from the sheet cassette is conveyed to the transfer roller 116. After the exposing and developing processes, the photoconductive drum 100 reaches a transfer position by its rotation. In a transfer process, a positive transfer voltage Vt of several hundred to one thousand volts is applied to the transfer roller 116. The developing agent on the photoconductive drum 100 is transferred onto the sheet by electrostatic force due to the difference in potential between the transfer roller 116 and the photoconductive drum 100. The developing agent transferred onto the sheet is fixed to the sheet by the pressure and heat of a fixing device (not shown). Thereafter, the sheet is ejected to the exterior, and the processes for printing one sheet are completed.

The charge roller 102 is made of material such as rubber. The charge roller 102 and the photosensitive drum 100 rotate with their surfaces touching. A charging phenomenon occurs by Paschen discharge at a minute gap between the photoconductive drum 100 and the charge roller 102. Such a charging method is called a contact charging method.

Figure 2:
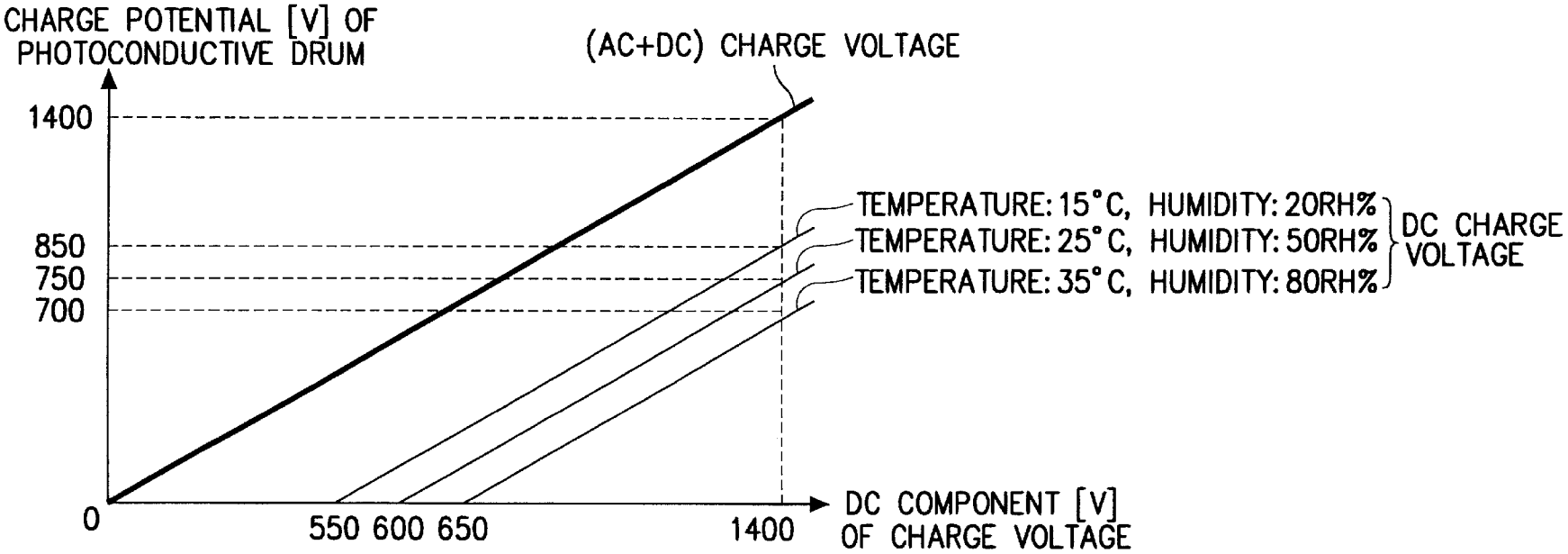
FIG. 2 is a graph illustrating the characteristic of a charge potential of a photoconductive drum with respect to a charge voltage, temperature and humidity.

The characteristic of the charge potential of the photoconductive drum 100 charged by the charge roller 102 varies according to the charge voltage Vch of the charge roller 102 and environmental conditions, that is, temperature and humidity, as indicated in FIG. 2. In FIG. 2, the vertical axis designates the charge potential of the photoconductive drum 100, and the horizontal axis designates a DC component of the charge voltage Vch of the charge roller 102. The charge voltage Vch applied to the charge roller 102 is a DC voltage, the charge potential of the photoconductive drum 100 is decreased as temperature and humidity are increased, and is increased as temperature and humidity are decreased.

The developing agent on the developing roller 106 is moved to the surface of the photoconductive drum 100 by the difference in potential between the photoconductive drum 100 and the developing roller 106. The moved quantity of the developing agent is proportional to the difference between the developing voltage Vb and the charge potential of the photoconductive drum 100. Under the same charge voltage Vch of the charge roller 102, the actual charge potential of the photoconductive drum 100 differs according to environmental conditions. Therefore, the quantity of the developing agent on the photoconductive drum 100 differs and thus image density varies. Consequently, the image density varies according to environmental conditions, resulting in a degradation in image quality.

In order to prevent the charge potential of the photoconductive drum 100 from varying according to environmental conditions, a charge voltage to which an AC component is superposed has been applied to the charge roller 102. Then the charge potential with a relatively stable characteristic is obtained as indicated in FIG. 2.

Figure 3:
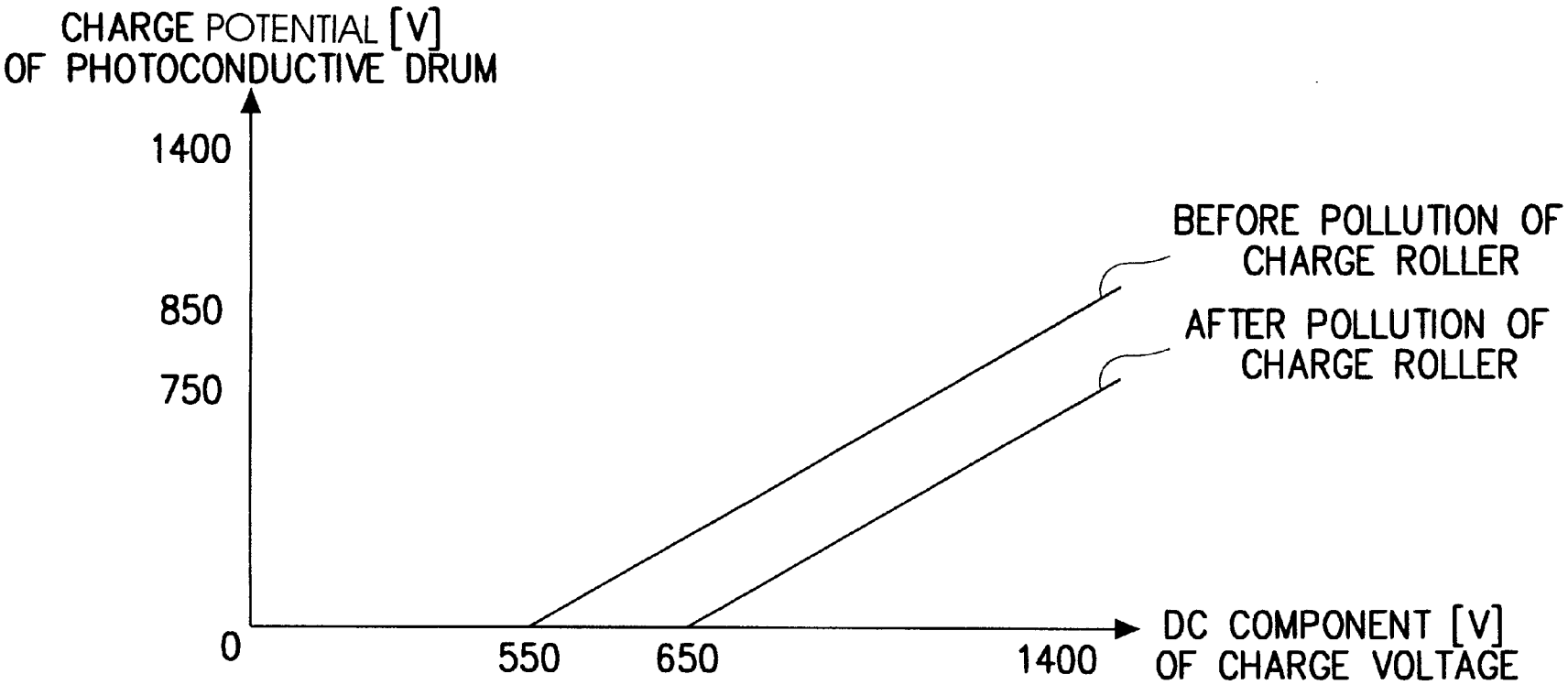
FIG. 3 is a graph illustrating the characteristic of a charge potential of a photoconductive drum with respect to the surface pollution of a charge roller.

The characteristic of the charge potential of the photoconductive drum 100 may differ when the charge roller 102 is polluted by the developing agent or paper dust, as shown in FIG. 3. If the charge roller 102 is polluted, the charge potential of the photoconductive drum 100 is lowered. The charge potential of the photoconductive drum 100 shows an unstable characteristic with respect to the charge voltage Vch of only a DC component. If the charge voltage Vch includes an AC component, the characteristic of the charge potential of the photoconductive drum 100 becomes relatively stable. However, since voltages applied to the photoconductive drum 100 and the charge roller 102 vary according to an AC characteristic of the charge voltage Vch, the electrostatic force therebetween differs. Then, the charge roller 102 having an elastic characteristic by its rubber material repeats contraction and expansion according to a period of an AC voltage frequency, and thus there is minute vibration. This vibration phenomenon brings about noise and a degradation in image quality. To prevent vibration noise and to improve image quality, there is additionally needed a vibration preventing device.

Figure 4:
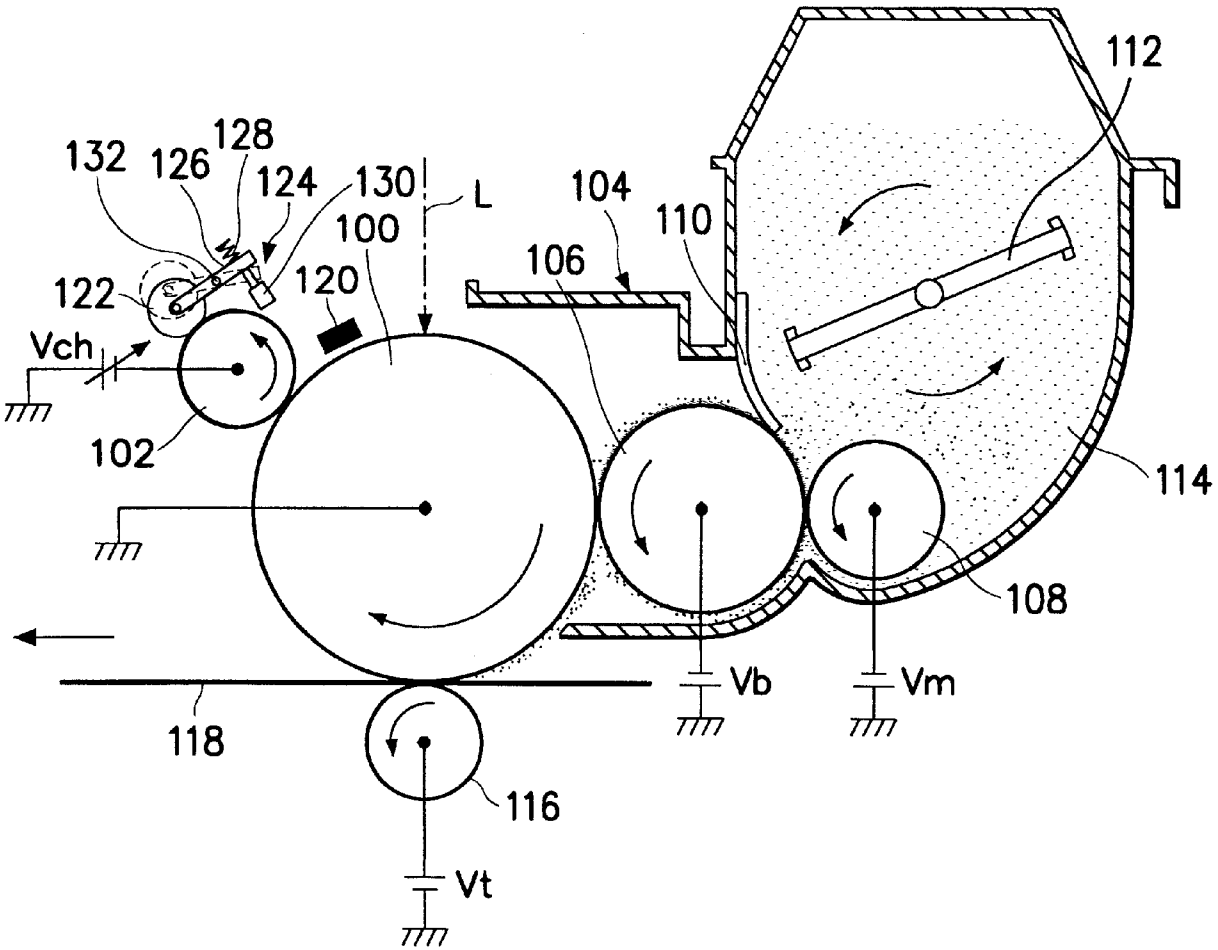
FIG. 4 illustrates an engine of an electrophotographic image forming apparatus including a contact charger according to a preferred embodiment of the present invention.

Referring to FIG. 4, in addition to the construction of FIG. 1, a potential sensor 120 is installed around a photoconductive drum 100 in order to detect a charge potential of the photoconductive drum 100 according to a change in environmental conditions. A cleaning roller 122 for cleaning a charge roller 102 is installed, and a cleaning driver 124 for driving the cleaning roller 122 is also provided. The potential sensor 120 which is generally used to detect a potential is installed on the photoconductive drum 100 between a charge position and an exposing position. The potential sensor 120 detects a charge potential of the surface of the photoconductive drum 100 before the photoconductive drum 100 is exposed. The cleaning roller 122 is in contact with or out of contact with the surface of the charge roller 102 under the control of the cleaning driver 124. When the cleaning roller 122 comes into contact with the surface of the charge roller 102, it cleans the surface of the charge roller 102. The cleaning driver 124 is comprised of a lever 126, a compression spring 128 and a solenoid 130. The cleaning driver 124 causes the cleaning roller 122 to be contact with or to be out of contact with the charge roller 102. The lever 126 is extended to both sides about a rotatable axle 132. An end of the lever 126 is connected to an axle of the cleaning roller 122, and the other end thereof is fixedly installed to a sash by the compression spring 128. The compression spring 128 pushes one end of the lever 126 toward the charge roller 102. The compression spring 128 and the solenoid 130 are oppositely installed at an end of the lever 126 to each other. If the solenoid 130 is driven, the compression spring 128 is pushed by the solenoid 130 and thus the cleaning roller 122 touches the charge roller 102. If the solenoid 130 is not driven, the cleaning roller 122 is separated from the charge roller 102.

Figure 5:
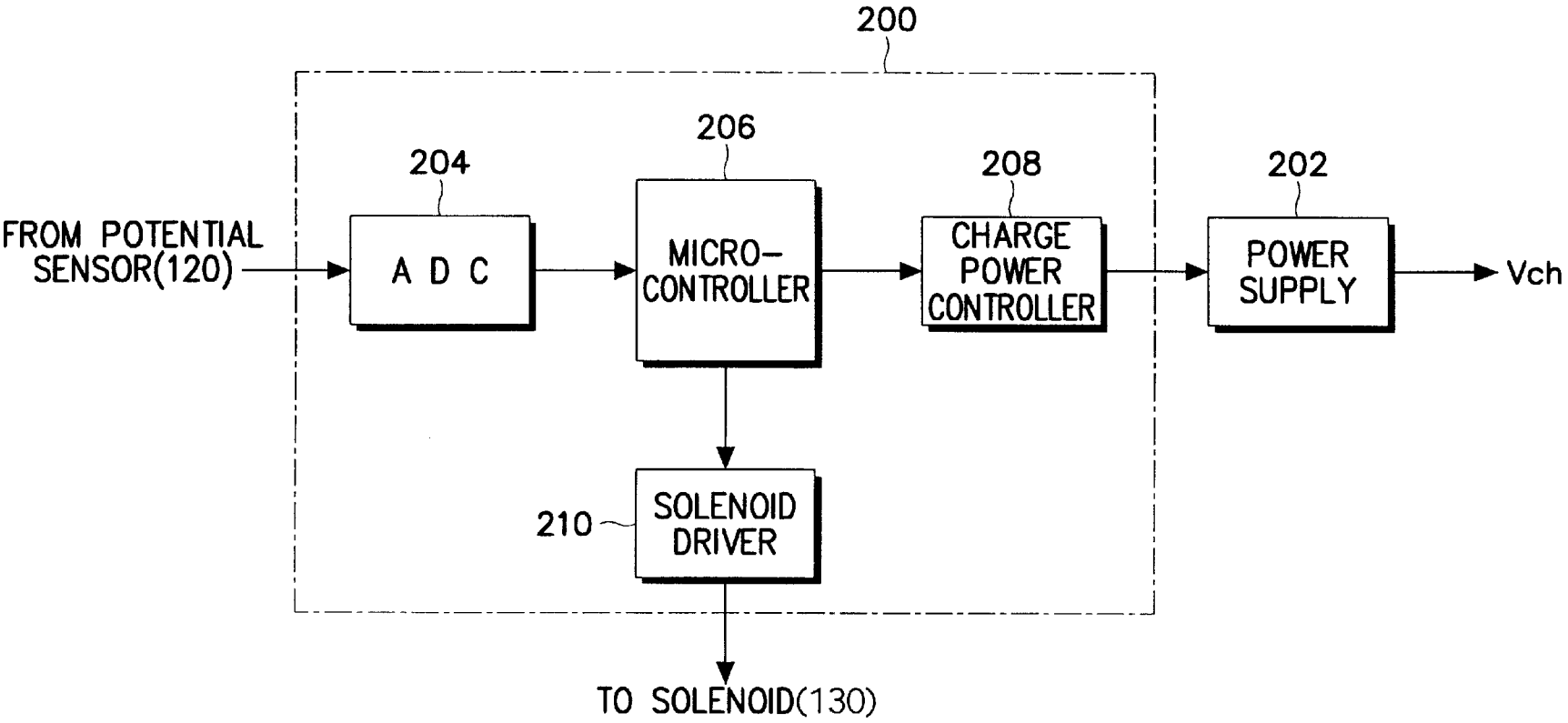
FIG. 5 is a block diagram of a charger according to a preferred embodiment of the present invention.

FIG. 5 is a block diagram of a charger according to a preferred embodiment of the present invention. The charger includes a control circuit 200 and a power supply 202. The control circuit 200 has an analog-to-digital converter (ADC) 204, a microcontroller 206, a charge power controller 208, and a solenoid driver 210. The ADC 204 converts a level of a charge potential of the photoconductive drum 100 detected from the potential sensor 120 into a digital value and supplies the digital value to the microcontroller 206 as a charge potential value. The microcontroller 206 compares the digital charge potential value with a specified value. If there is any difference therebetween, the microcontroller 206 changes a charge voltage Vch which is an output of the power supply 202 through the charge power controller 208. The specified value is preset to a target charge potential value. The microcontroller 206 causes the solenoid driver 210 to drive the solenoid 130 of the cleaning driver 124 so that the cleaning roller 122 can be contact with the charge roller 102, or not to drive the solenoid 130 so that the cleaning roller 122 can be distanced from the charge roller 102. The microcontroller 206 is used by programing a microcontroller employed to control the engine in the image forming apparatus having the engine of FIG. 4 to perform a function of a processing operation shown in FIG. 6. The power supply 202 uses a general variable power supply. The power supply 202 is connected to the charge roller 102 and supplies the variable DC charge voltage Vch to the charge roller 102.

Figure 6:
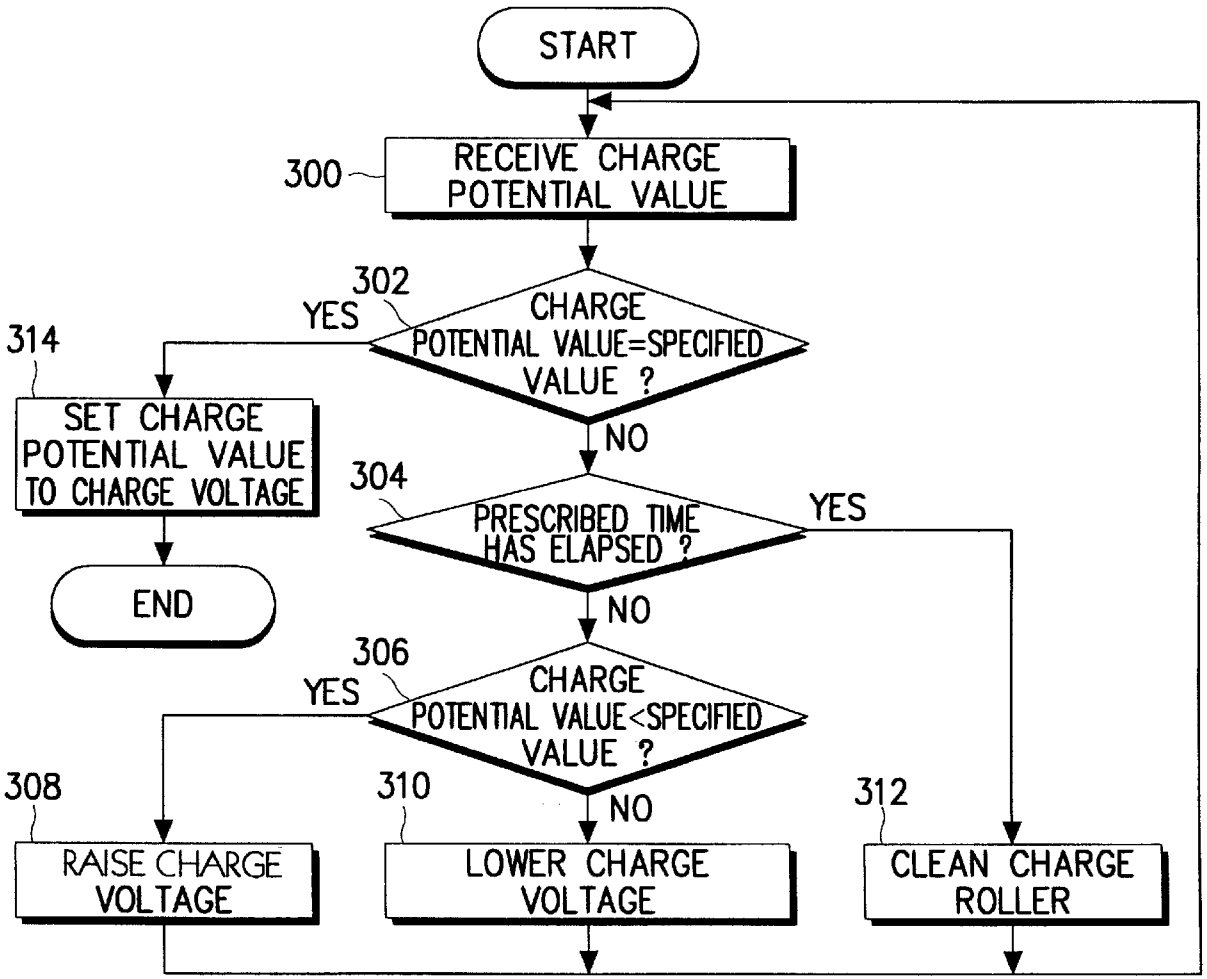
FIG. 6 is a flowchart illustrating a processing operation of a microcontroller shown in FIG. 5 according to a preferred embodiment of the present invention.

FIG. 6 is a flowchart illustrating a processing operation of the microcontroller 206 shown in FIG. 5. The function of the precessing operation shown in FIG. 6 may be performed during an initialization operation or a warm-up of the image forming apparatus, or may be performed by a selection of the user. Referring to FIG. 6, the microcontroller 206 receives a charge potential value from the potential sensor 120 at step 300, and then compares the received charge potential value with a specified value at step 302. If they are equal to each other, the microcontroller 206 sets the received charge potential value to the charge voltage Vch at step 314.

If the charge potential value differs from the specified value at step 302, the microcontroller 206 checks if a prescribed time has elapsed at step 304. If not, the microcontroller 206 checks whether the charge potential value is less than the specified value at step 306. If yes, the microcontroller 206 raises the charge voltage Vch through the charge power controller 208 at step 308 and proceeds back to step 300. If the charge potential value is greater than the specified value, the microcontroller 206 lowers the charge voltage Vch through the charge power controller 208 at step 310 and proceeds back to step 300. By repeating such an operation, the charge potential of the photoconductive drum 100 is adjusted to the specified value.

Therefore, even if there is a change in environmental conditions, the charge potential of the photoconductive drum 100 is maintained at a constant value by changing the charge voltage Vch, and thus uniform image density can be maintained. Since the charge voltage Vch includes only a DC voltage without an AC voltage, there is no need to install an additional vibration preventing device.

The developing density may vary because the quantity of the developing agent moving between the developing roller 106 and a photoconductive material varies by electrostatic force due to the difference between an exposing potential on the photoconductive drum 100 and a developing potential. In order to achieve a target value for obtaining uniform developing density, the developing voltage Vb may be changed instead of the charge voltage Vch.

Meanwhile, if the surface of the charge roller 102 is polluted by the developing agent or paper dust, a desired charge potential may be not obtained even though the charge voltage Vch varies. In this case, the charge roller 102 should be cleaned. If no charge potential of the specified value is obtained within a prescribed time, the microcontroller 206 causes the cleaning roller 122 to clean the charge roller 102 by driving the solenoid 128 of the cleaning driver 124 at step 312. Thereafter, the charge voltage Vch is changed by the above-described operation. Therefore, even if the charge roller 102 is polluted, a uniform image density is obtained.

As may be apparent from the aforementioned description, the charge potential of the photoconductive drum can be maintained at a specified value. The uniform image density can be obtained even if there is a change in a characteristic of the charge roller due to pollution, or environmental conditions vary. Moreover, there is no need to install a vibration preventing device. Since only a DC voltage is applied to the charge roller, the construction of the power supply can be simplified.

While the invention has been shown and described with reference to certain preferred embodiments thereof, it will be understood by those skilled in the art that various changes in form and details may be made therein. For example, it may be possible not to use the cleaning roller 122. Therefore, the present invention should be understood as including all possible embodiments and modifications which do not depart from the spirit and scope of the invention as defined by the appended claims.

What is claimed is:

1. A charger for charging the surface of a photoconductive drum by a contact charging method in an electrophotographic image forming apparatus, said photoconductive drum having its charged surface potential varying according to exposure, said charger comprising:

a charge roller for charging an unexposed surface of said photoconductive drum to a prescribed potential by contact with the surface of said photoconductive drum;

a power supply connected to said charge roller, for supplying a variable direct current (DC) charge voltage to said charge roller;

a potential sensor installed around said photoconductive drum, for detecting a charge potential value of the unexposed surface of said photoconductive drum;

a cleaner for cleaning the surface of said photoconductive drum; and a controller for comparing said charge potential value detected by said potential sensor with a specified value, and changing said charge voltage generated by said power supply upon detecting any difference therebetween, so as to maintain the charge potential of said photoconductive drum at a constant value, and for causing said cleaner to clean the surface of said photoconductive drum is said charge potential value fails to reach said specified value within a prescribed time.

2. A charger as claimed in claim 1, said controller raising said charge voltage when said charge potential value is less than said specified value, and lowering said charge voltage when said charge potential value is greater than said specified value.

3. A charger for charging the surface of a photoconductive drum by a contact charging method in an electrophotographic image forming apparatus, said photoconductive drum having its charged surface potential varying according to exposure, said charger comprising:

a charge roller for charging an unexposed surface of said photoconductive drum to a prescribed potential by contact with the surface of said photoconductive drum;

a power supply connected to said charge roller, for supplying a variable direct current (DC) charge voltage to said charge roller;

a potential sensor installed around said photoconductive drum, for detecting a charge potential value of the unexposed surface of said photoconductive drum;

a cleaning roller for selectively touching a surface of said charge roller, and cleaning the surface of said charge roller upon touching the surface of said charge roller;

a cleaning driver for causing said cleaning roller to be contact with or to be out of contact with the surface of said charge roller; and a controller for comparing said charge potential value detected by said potential sensor with a specified value, changing said charge voltage generated by said power supply upon detecting any difference therebetween, so as to maintain the charge potential of said photoconductive drum at a constant value, and causing said cleaning roller to be contact with said charge roller by said cleaning driver if said charge potential value fails to reach said specified value within a prescribed time.

4. A charger as claimed in claim 3, said controller raising said charge voltage when said charge potential value is less than said specified value, and lowering said charge voltage when said charge potential value is greater than said specified value.

5. A method of charging the surface of a photoconductive drum by a contact charging method in an electrophotographic image forming apparatus, said photoconductive drum having its charged surface potential varying according to exposure, comprising the steps of:

charging an unexposed surface of said photoconductive drum to a prescribed potential by contact with the surface of said photoconductive drum with a charge roller;

supplying a variable direct current (DC) charge voltage to said charge roller;

detecting a charge potential value of the unexposed surface of said photoconductive drum; and comparing said detected charge potential value with a specified value, and changing said charge voltage upon detecting any difference therebetween, so as to maintain the charge potential of said photoconductive drum at a constant value, and cleaning the surface of said photoconductive drum if said charge potential value fails to reach said specified value within a prescribed time.

6. The method as claimed in claim 5, said charge voltage being raised when said charge potential value is less than said specified value, and said charge voltage being lowered when said charge potential value is greater than said specified value.

7. A method of charging the surface of a photoconductive drum by a contact charging method in an electrophotographic image forming apparatus, said photoconductive drum having its charged surface potential varying according to exposure, comprising the steps of:

charging an unexposed surface of said photoconductive drum to a prescribed potential by contact with the surface of said photoconductive drum with a charge roller;

supplying a variable direct current (DC) charge voltage to said charge roller;

detecting a charge potential value of the unexposed surface of said photoconductive drum;

selectively touching a surface of said charge roller with a cleaning roller, and cleaning the surface of said charge roller upon touching the surface of said charge roller;

causing said cleaning roller to be contact with or to be out of contact with the surface of said charge roller; and comparing said detected charge potential value with a specified value, changing said charge voltage upon detecting any difference therebetween, so as to maintain the charge potential of said photoconductive drum at a constant value, and causing said cleaning roller to be contact with said charge roller if said charge potential value fails to reach said specified value within a prescribed time.

8. A method as claimed in claim 7, said charge voltage being raised when said charge potential value is less than said specified value, and said charge voltage being lowered when said charge potential value is greater than said specified value.

* * * * *